United States Patent [19]

Dufour

[11] Patent Number: 4,837,949

[45] Date of Patent: Jun. 13, 1989

[54] SHOE SOLE

[75] Inventor: Pierre Dufour, Annecy, France

[73] Assignee: Salomon S. A., Annecy Cedex, France

[21] Appl. No.: 137,127

[22] Filed: Dec. 23, 1987

[30] Foreign Application Priority Data

Dec. 23, 1986 [FR] France ..... 86 18113

[51] Int. Cl.[4] ..... A43B 5/00; A43B 13/14

[52] U.S. Cl. ..... 36/127; 36/25 R; 36/31; 36/114

[58] Field of Search ..... 36/30 A, 31, 67 R, 67 A, 36/67 D, 127, 134, 126, 25 R, 59 R, 59 C, 114

[56] References Cited

U.S. PATENT DOCUMENTS

| | | | |
|---|---|---|---|
| 2,038,972 | 4/1936 | Watanabe | 36/59 C |
| 3,487,563 | 1/1970 | Austin | 36/67 D |
| 4,754,561 | 7/1988 | Dufour | 36/127 |

FOREIGN PATENT DOCUMENTS

| | | | |
|---|---|---|---|
| 3135347 | 3/1983 | Fed. Rep. of Germany | 36/126 |
| 2553636 | 4/1985 | France | 36/25 R |
| 1099941 | 6/1984 | U.S.S.R. | 36/25 R |
| 1107153 | 3/1968 | United Kingdom | 36/67 A |
| 1286902 | 8/1972 | United Kingdom | 36/25 R |

*Primary Examiner*—James Kee Chi

*Attorney, Agent, or Firm*—Pollock, Vande Sande & Priddy

[57] ABSTRACT

A walking sole for sports shoes, particularly golf shoes, having, on at least one of its lateral edges, a series of substantially transverse grooves, filled with a material having a degree of elasticity superior to that of the material making up the sole. The grooves are provided in the front portion of at least one of the lateral edges (1*a*,1*b*) which extends the length of the frontal area of the sole (1) which provides support for the front part of the foot of the wearer of the shoe, and they mark the boundaries of at least one flexible tongue (7) transversally around an axis of flexion (X) joining the internal ends of the grooves (3). (FIG. 1).

18 Claims, 3 Drawing Sheets

SHOE SOLE

FIELD OF THE INVENTION

The invention relates to a walking sole for sports shoes, in particular golf shoes, as well as to a shoe equipped with this kind of sole.

BACKGROUND OF THE INVENTION

There already exist shoe soles of which the edges are notched with grooves that are transverse in relation to the longitudinal axis of the shoe, in order to facilitate a relative torsion of the front part of the sole in relation to its rear part. For example, FR-A-1 218 101 describes a shoe whose walking sole is divided by means of several transverse grooves, which begin at the edges of the sole and are located in the area of the sole under the arch of the foot. These grooves are filled with a material possessing a degree of elasticity superior to that of the material forming the entirety of the sole. Moreover, FR-A-2 553 636 describes a shoe of which the middle sole has, along the front part of the exterior edge, grooves containing pieces made of a material of a hardness greater than that of the material making up the layer of the middle sole. This last arrangement is aimed basically at improving the flexibility and cushioning characteristics in the direction of the foot's motion during walking, running, or jumping.

SUMMARY OF THE INVENTION

The invention involves more particularly, a sole for golf shoes that is designed to facilitate the rotation of the foot during the "swing" movement, while at the same time guaranteeing an optimal grip on the ground.

For this purpose, this walking sole for a sport shoe, in particular a golf shoe, has, in at least one of its lateral edges, a series of spaced approximately transverse grooves, extending to the edge of the sole and toward the central part thereof, the grooves being filled with a material having a degree of elasticity superior to that of the material making up the sole and which forms individual elastic filling pieces embedded in the respective grooves. The grooves are provided in the front part of at least one of the lateral edges extending along the front area of the sole, from which the front part of the foot of the wearer of the shoe gains its support, and these grooves form the boundaries of least one flexible tongue situated transversally around a line joining the internal ends of the grooves.

According to another characteristic of the invention, each of the flexible tongues has attached to it at least one cleat designed to embed itself into the ground, this cleat being fastened permanently to the sole during its molding, or being fastened, after the molding of the sole, to an anchoring piece provided during molding and built into the flexible tongue.

BRIEF DESCRIPTION OF THE DRAWINGS

In order that the invention may be more clearly understood, several embodiments will be described below by way of example, with reference to the drawings, in which.

DESCRIPTION OF THE PREFERRED EMBODIMENTS

Figure 1:
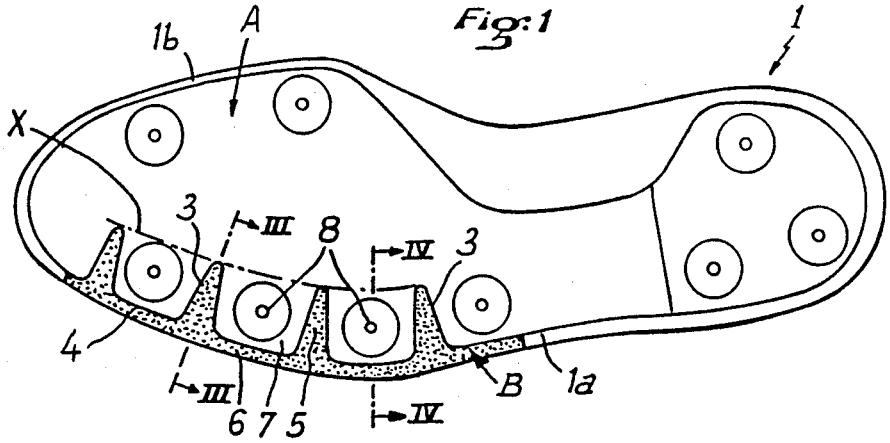
FIG. 1 is a bottom plan view of a walking sole according to the invention and incorporated into a golf shoe, showing how the individual elastic filling pieces are joined together by a border made of an elastic material.
Figure 20:
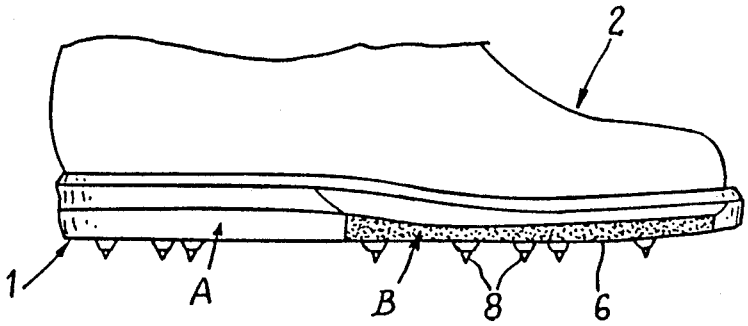
FIG. 20 is a schematic elevation view of a golf shoe having a walking sole according to the invention.

The walking sole shown in its entirety in FIG. 1 is designed especially to be incorporated into a golf shoe (2), shown in FIG. 20. This walking sole (1) is molded using a relatively rigid plastic material.

Figure 2:
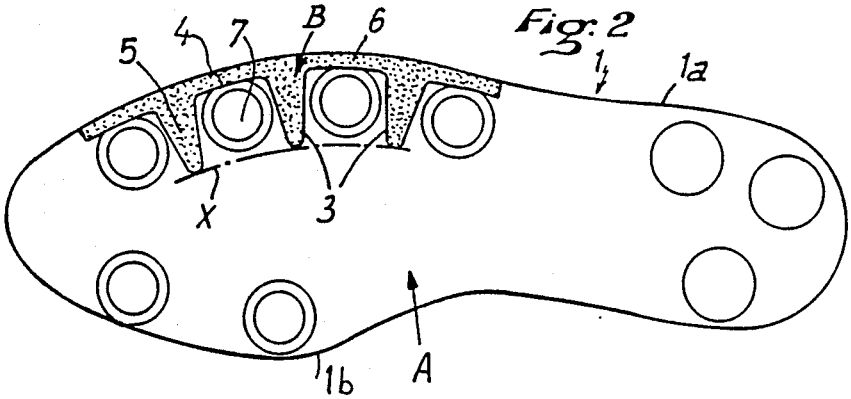
FIG. 2 is a plan view of the walking sole shown in FIG. 1.

According to the invention, the front part of the walking sole has particular transverse flexibility in relation to the place where the front part of the golfer's foot gains its support, which facilitates the rotation of the foot during the swing. For this purpose, the walking sole (1) has, in its front part and at least along its outer edge (1*a*), a combination of two materials having different degrees of elasticity. More precisely, the walking sole (1) is made up of two parts A and B made of plastic materials having two different degrees of elasticity. The largest portion of the walking sole (1) is molded using a relatively rigid plastic material and it has, along the front part of its outer edge (1*a*), a molded part B of a plastic material of an essentially elastic nature or having a degree of elasticity clearly superior to that of the plastic material making up the major part A of the sole. The relatively elastic plastic material used in the molded layer B fills in a series of grooves (3) which are spaced at intervals and which are formed during the molding of the main part A of the sole. These grooves end on the edge (4) of the part A and extend in the direction of the median longitudinal plane of the sole, with the same relative position or with different positions, as indicated in FIGS. 1 and 2. The grooves (3) may be marked off by parallel or convergent sides in the direction of the median longitudinal plane, so as to create a triangular shape. In the grooves (3) are thus formed individual elastic filling pieces (5) which may be joined by a border (6) created by molding at the same time as the individual elastic filling pieces (3). In other words, the molded part B made of elastic material is formed, according to the embodiment shown in FIGS. 1 and 2, by the continuous border (6), which actually makes up a part of the exterior edge (1*a*) of the walking sole (1), and by the individual elastic filling pieces (5) which constitute a kind of teeth closely embedded in the grooves (3) of the part A made of more or less rigid plastic material.

The grooves (3) of part A of the walking sole form the boundaries of the tongues (7) making up the main molded section A, made of a rigid material. These tongues are flexible transversally around lines X extending through the internal ends of the grooves (3). To these tongues (7) may be attached the cleats (8) extending downwardly to ensure anchoring of the shoe (2) in the ground.

The individual elastic filling pieces (5) may have either the same thickness as that of the rigid section A of the sole at the place where the grooves (3) are formed, or a smaller thickness, so that each elastic filling piece partially fills the groove (3) in which it is embedded, or a greater thickness, in which case it protrudes above the groove (3).

Figure 3:
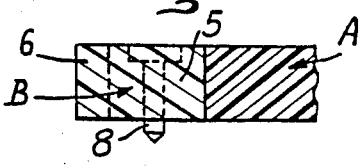
FIG. 3 is a vertical cross-section view along line III—III in FIG. 1.
Figure 4:
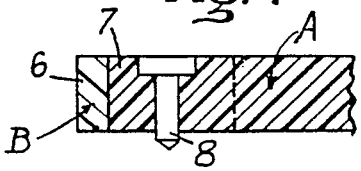
FIG. 4 is a vertical cross-section view along line IV—IV in FIG. 1.
Figure 6:
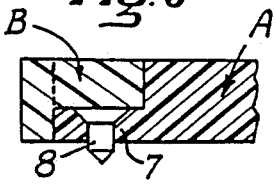
FIG. 6 is a vertical cross-section view along line VI—VI in FIG. 5.
Figure 5:
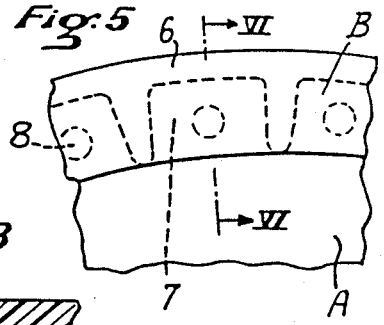
FIG. 5 is a partial schematic diagram of another embodiment, in which the flexible tongues are placed under a layer of elastic material.

The flexible tongues (7) may have the same thickness as the individual elastic filling pieces (5), as indicated in FIGS. 3 and 4, or a smaller thickness. In this case, each tongue (7) may extend toward the outside from its starting place in the lower part of the edge of the main section A of the sole, made of rigid material, as indicated in FIGS. 5 and 6; it is, in this case, covered with elastic material B.

Figure 7:
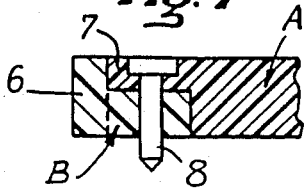
FIGS. 7 and 8 are vertical cross-section views analogous to FIG. 6, showing other forms of execution.

In the embodiment shown in FIG. 7, the flexible tongue (7) extends toward the outside from its starting point in the upper part of the rigid main section A of the sole, and in this case it covers a portion of the border (6) made of elastic material B.

Figure 8:
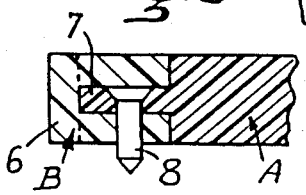

In the embodiment shown in FIG. 8, the flexible tongue (7) extends toward the outside at mid-thickness of the main section A and it is thus overlapped by the plastic material B which extends above and below it.

Figure 9:
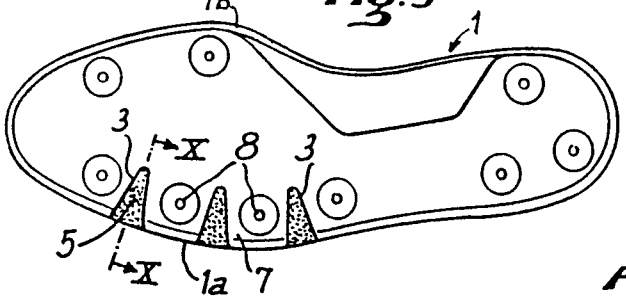
FIG. 9 is a bottom plan view of a further embodiment of the walking sole, in which the individual elastic filling pieces are separated.
Figure 10:
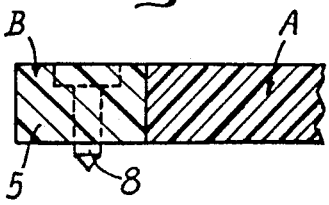
FIG. 10 is a vertical cross-section view along line X—X in FIG. 9.
Figure 11:
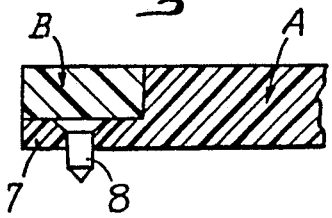
FIGS. 11, 12, and 13 are partial vertical cross-section views other variant designs.
Figure 12:
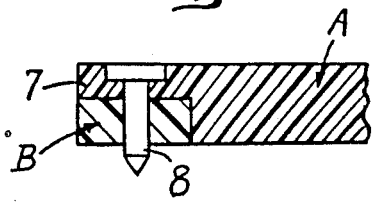
Figure 13:
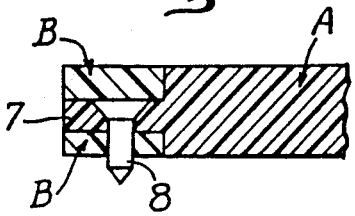

In the embodiment shown in FIG. 9, each flexible tongue extends up to the outer edge of the sole and the individual elastic filling pieces (5) are separated. Here again, the flexible tongues (7) may have the same thickness as that of the main section of the sole A, as shown in FIG. 10, or a lesser thickness as shown in FIGS. 11, 12, and 13, in which it is evident that the flexible tongue (7) is found in the lower part, the upper part, and the middle part, respectively, in relation to the thickness of the sole.

The lines of flexion X (FIG. 1), by which the different flexible tongues (7) are attached to the rest of the sole, may be made up of the areas of reduced thickness of the sole. These areas of reduced thickness may exhibit a progressive, or an abrupt, variation in thickness. In the first case, each of the areas is formed by an area which grows progressively smaller. In the second case, each area of reduced thickness is bounded by a groove (10) (FIGS. 14 and 15), which is formed in the upper surface of the sole and which is more or less parallel to the edge of the sole, passing through the internal ends of the various grooves (3).

However, this groove (10) may, as well, be set in the lower surface of the sole, or else the sole may have two grooves (10) on the upper and lower surfaces, respectively, these grooves being set in the same vertical plane in order to mark off between them an area of reduced thickness which facilitates the flexion of the tongue (7).

Figure 14:
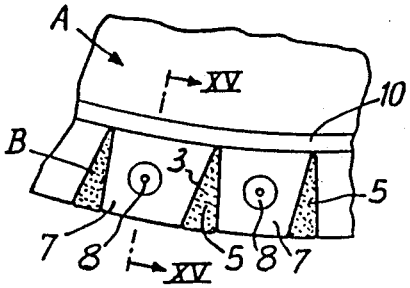
FIG. 14 is a partial bottom plan view showing another embodiment of the sole.
Figure 15:
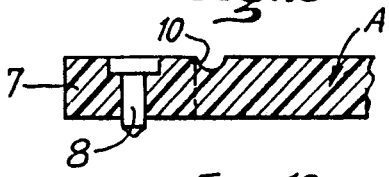
FIG. 15 is a vertical cross-section view along line XV—XV in FIG. 14.

FIGS. 14 and 15 illustrate a walking sole with a groove (10) in its upper surface, having several flexible tongues (7) of which each one has a cleat (8), and grooves (3) extending up to the outer edge of the sole, so that the individual elastic filling pieces are separated.

Figure 16:
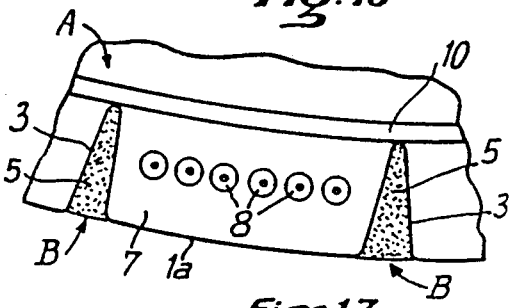
FIGS. 16, 17 and 18 are partial bottom plan views showing still further embodiments of the sole.

In the embodiment shown in FIG. 16, the sole has, in its outer edge (1*a*), only two grooves (3) which define a single flexible tongue (7) equipped with several adjacent cleats (8). Here again, the grooves (3) extend from the groove (10) to the outer edge (1*a*) of the sole and are not joined by an external border.

Figure 17:
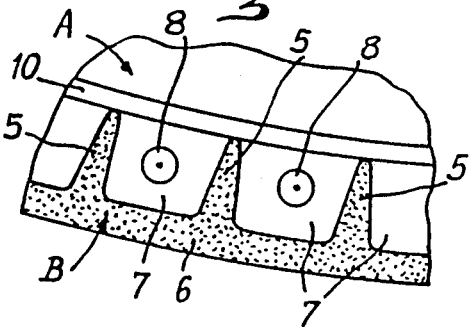
Figure 18:
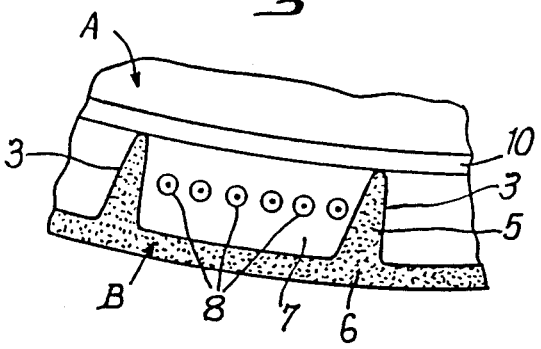

On the contrary, in the embodiments shown in FIGS. 17 and 18, the individual elastic filling pieces (5) are joined by a border (6). In FIG. 17, the sole has several flexible tongues (7), each equipped with a cleat (8), while in FIG. 18, the sole has a single flexible tongue (7) having a series of adjacent cleats (8), as in the case of FIG. 16.

The different cleats (8) may be attached to the flexible tongues (7) of the walking sole (1) during molding of the sole; in this case, they are held firmly within the rigid plastic material which makes up the main section A.

Figure 19:
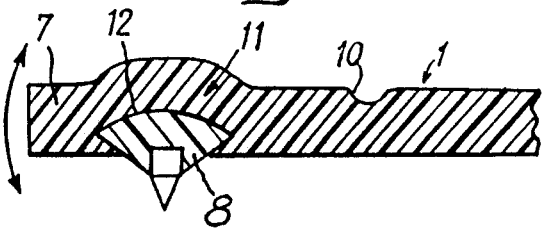
FIG. 19 is a partial cross-section elevation view of a walking sole having a cleat embedded in an anchoring piece of the sole, after molding.

In the embodiment shown in FIG. 19, the cleat (8) is embedded by force in an anchoring piece (11) which is formed in the sole (1) during molding thereof. This anchoring piece (11) has a cavity on its lower surface (12) that receives and holds in place in an appropriate way the head of the cleat (8) embedded by force in that cavity.

FIG. 20 illustrates a golf shoe equipped with walking sole which conforms to the invention.

Although in the embodiments of the invention described above, the part B made of molded elastic material is only provided for on the side of the external edge (1*a*) of the sole (1), it is evident that the sole may be equipped with a similar piece made of elastic material on the front part of its inner edge (1*b*) or, simultaneously, on both edges (1*a* and 1*b*).

What is claimed is:

1. Walking sole for a sport shoe, having in at least one of its lateral edges a series of spaced, substantially transverse grooves terminated in an edge of said sole and extending toward a central part of said sole, said grooves being filled with a material having greater elasticity than the material making up the sole and forming individual elastic filling pieces embedded in respective said grooves, grooves being provided in a front portion of said at least one of said lateral edges (1*a*, 1*b*) which extends the length of said front portion of said sole (1) which gives support to the front part of the foot of the wearer of the shoe, and wherein said grooves delimit the boundaries of at least one flexible tongue (7) transversely around an axis of flexion (X) joining internal ends of said grooves (3).

2. Walking sole according to claim 1, wherein the walking sole (1) contains several flexible tongues (7).

3. Walking sole according to claim 2, wherein the internal ends of the grooves (3) are joined by extended areas of reduced thickness constituting axes of flexion for the tongues (7).

4. Walking sole according to claim 3, wherein the area of reduced thickness is bounded by at least one groove (10) set in at least one surface of the sole extending between the internal ends of the grooves (3).

5. Walking sole according to claim 3, wherein the area of reduced thickness is made up of an area growing progressively smaller.

6. Walking sole having a main section (A) made of a more or less rigid material and a section (B) made of an elastic material making up the individual elastic filling pieces (5) according to claim 1, wherein the thickness of the main rigid section (A) of the sole is equal to the thickness of the section (B) making up the individual elastic filling pieces (5).

7. Walking sole according to claim 1, wherein the thickness of each flexible tongue (7) is equal to the thickness of the main section (A) of the sole.

8. Walking sole according to claim 1, wherein the thickness of each flexible tongue (7) is less than the thickness of the main section (A) of the sole.

9. Walking sole according to claim 1, wherein the individual elastic filling pieces (5) are independently formed.

10. Walking sole acording to claim 1, wherein the individual elastic filling pieces (5) are joined by a border (6) of the same elastic material extending the length of the edge (1*a*) of the sole (1), within the external edge of the sole.

11. Walking sole according to claim 1, wherein each flexible tongue (7) extends from the lower portion of the sole and is placed below a layer of elastic material.

12. Walking sole according to claim 1, wherein each flexible tongue (7) extends from the upper portion of the sole and is placed above a layer of elastic material.

13. Walking sole according to claim 1, wherein each flexible tongue (7) extends from the median part of the sole's thickness and is enveloped in a layer of plastic material extending both above and below it.

14. Walking sole according to claim 1, wherein cleats (8) are attached to said flexible tongues (7), bounded by said grooves (3), and said cleats extend below the sole.

15. Walking sole according to claim 1, wherein the sole contains a single flexible tongue (7) equipped with a series of adjacent cleats (8).

16. Walking sole according to claim 14, wherein the cleats (8) are firmly attached to the flexible tongues (7) of the sole during molding of the sole.

17. Walking sole according to claim 14, wherein the cleats (8) are embedded and retained after molding of the sole, in anchoring pieces (11) molded with the flexible tongues (7).

18. Sports shoe, especially a golf shoe, equipped with a walking sole according to claim 1.

* * * * *